United States Patent [19]

Katsura

[11] Patent Number: 4,665,014

[45] Date of Patent: May 12, 1987

[54] POLYOLEFIN COATED PHOTOGRAPHIC PAPER SUPPORT

[75] Inventor: Toru Katsura, Tokyo, Japan

[73] Assignee: Mitsubishi Paper Mills, Inc., Tokyo, Japan

[21] Appl. No.: 771,159

[22] Filed: Aug. 30, 1985

Related U.S. Application Data

[63] Continuation of Ser. No. 554,172, Nov. 22, 1983, abandoned, which is a continuation of Ser. No. 359,981, Mar. 19, 1982, abandoned.

[30] Foreign Application Priority Data

Mar. 24, 1981 [JP] Japan ..... 56-42773

[51] Int. Cl.[4] ..... G03C 1/76

[52] U.S. Cl. ..... 430/538; 162/135; 162/158; 162/175; 162/169; 162/168.3; 428/513

[58] Field of Search ..... 428/513; 430/538; 427/209; 162/135, 158, 175, 169, 168.3

[56] References Cited

U.S. PATENT DOCUMENTS

| | | | |
|---|---|---|---|
| 3,320,066 | 5/1967 | Garth | 430/538 |
| 3,592,731 | 7/1971 | Griggs | 430/538 |
| 3,630,830 | 12/1971 | Herdle et al. | 430/538 |
| 4,331,508 | 5/1982 | Miyama et al. | 430/538 |
| 4,353,981 | 10/1982 | Noda et al. | 430/538 |

*Primary Examiner*—Jack P. Brammer

*Attorney, Agent, or Firm*—Cushman, Darby, Cushman

[57] ABSTRACT

A photographic paper support comprising a base paper coated on both sides with a polyolefin resin is markedly improved in resistance to the stain occurring around the edges after development processing (edge stain), by the inclusion of an anionic polyacrylamide and a cationic starch in said base paper.

3 Claims, No Drawings

POLYOLEFIN COATED PHOTOGRAPHIC PAPER SUPPORT

This is a continuation of application Ser. No. 554,172, filed Nov. 22, 1983, which was abandoned upon the filing hereof, which is a continuation of application Ser. No. 359,981, filed Mar. 19, 1982, now abandoned.

This invention relates to a photographic paper support comprising a base paper sheet coated on both sides with a polyolefin resin.

Paper has long been used as a support in photographic paper, because of its advantages in appearance, stiffness, strength and cost. However, a chief disadvantage of paper as a photographic support is a high absorptiveness for developers. In view of the rapid development processing, absorption of the developers by the paper support is undesirable. Accordingly, it is a widespread practice to coat the base paper on both sides with water-resistant resins such as polyolefins for the purpose of reducing the water absorptiveness of base paper. By this means, the paper support is protected from the permeation of developers through both sides (surfaces), but not from the permeation through the edges. On being applied with heat or with the lapse of time, the developer retained by the support tends to manifest brownish discoloration, forming stains on the frame around pictures, which spoil the photographic value.

In order to prevent the developer from penetration through the edges, a neutral sizing agent has been internally added to the base paper. Although effective in imparting to the base paper a resistance against the penetration of developers under static conditions, yet the internal addition of a neutral sizing agent is insufficient to protect the support against penetration when it is processed under applied stress as is the case with the development in an automatic processor. In order to improve the resistance against processing under applied stress, it has been known that it is necessary to incorporate a dry or wet strength agent in the base paper. The strength agent for use as an internal additive in making the base paper is required to be in compliance with the following conditions: (1) it should exert a reinforcing effect on the base paper sufficient to withstand the stress developed in an automatic processor, (2) it should not adsorb the developer which causes discoloration, (3) it should not interface with the effectiveness of a neutral sizing agent used as an internal additive, and (4) it should not exert an adverse effect such as fogging on the photographic quality.

The strength agents are broadly classified into anionic agents such as guar gum, carboxyl-modified polyvinyl alcohol, and anionic polyacrylamide, and cationic agents such as cationic starch, cationic polyacrylamide, and polyamide-polyamine-epichlorohydrin. Although effective in improving sufficiently the paper strength, the internal addition of an anionic reinforcing agent is unsuitable, because it affects adversely the effectiveness of a neutral sizing agent. The cationic strength agent is widely used in paper making under neutral conditions but presents problems when used alone as an internal additive in making the base paper for a photographic paper support, because not only it does not afford a sufficient improvement in the paper strength, but also it is likely to adsorb a developer, giving rise to discoloration or stain.

It is also known to use the anionic and the cationic strength agents in combination. Although a sufficient paper strengthening effect is realizable by the joint use of said two types of strength agents, yet most of the combinations were found unsatisfactory in preventing the stain occurring in the area adjacent to the edge of photographic paper (hereinafter referred to briefly as "edge stain") after development.

An object of this invention is to provide a photographic paper support protected against the edge stain which takes place after the development processing in an automatic processor.

As a result of an extensive study conducted to solve the above problems, the present inventor found that it is possible to improve sufficiently the strength of base paper without injuring the effect of sizing and to reduce to a great degree the edge stain occurring after development, by the inclusion of an anionic polyacrylamide and a cationic starch in the base paper. This invention is predicated upon the said discovery.

The gist of this invention, therefore, is the inclusion of an anionic polyacrylamide and a cationic starch in the base paper which is subsequently coated on both sides with a polyolefin resin to form a photographic paper support.

The anionic polyacrylamides used in this invention include those paper strength agents of the anionic polyacrylamide type, such as partial hydrolyzates of homopolymers of acrylamide or of copolymers of acrylamide with other copolymerizable vinyl monomers, and copolymers of acrylamide with maleic anhydride, acrylic acid, or salts of these acids.

Examples of the cationic starches used in this invention include aminoethylated starch formed by the reaction of starch with ethyleneimine, a reaction product of starch and a polyalkylenepolyamine, a product formed by the reaction of starch with a halogenated amide such as 2-dimethylaminoethyl chloride in the presence of an alkali, and a product formed by the reaction in an alkaline medium between starch and a quaternary ammonium salt such as 2,3-epoxypropyltrimethylammonium chloride.

The suitable weight ratio of the anionic polyacrylamide to the cationic starch is in the range of from 1/30 to $\frac{1}{3}$. If the ratio is less than 1/30, the preventive effect on the edge stain of the photographic paper occurring after development becomes insufficient, while if the ratio exceeds $\frac{1}{3}$, the distance of penetration of a developer from the edge becomes larger because of the injurious effect of the anionic polyacrylamide upon the sizing agent.

The base paper for use in the present photographic paper support may be incorporated with a neutral sizing agent. Examples of neutral sizing agents include organic ketene dimers, substituted cyclic dicarboxylic anhydrdides, and epoxidized higher fatty acid amides. These are used each alone or in combinations. When a neutral sizing agent is allowed to be included in the base paper, it is preferable to use a combination of an organic ketene dimer and an epoxidized higher fatty acid amide in a ratio of preferably 3/5 to 7/1. The base paper may contain a combination of a neutral sizing agent and polyaminopolyamide-epichlorohydrin.

Suitable polyolefins to be coated on the base paper are homopolymers of $\alpha$-olefins such as ethylene and propylene, copolymers of two or more $\alpha$-olefins, copolymers of $\alpha$-olefins as major constituents and other copolymerizable monomers, and mixtures of these polymers. Low- or high-density polyethylene or a mixture thereof is preferred. The resins may contain white pigments such as titanium oxide and alumina, colored pigments, other additives commonly used in resins such as stabilizers, antioxidants, dispersants and lubricants.

The polyolefin-coated paper support is manufactured by the method of so-called extrusion coating, wherein a molten resin is spread over the traveling base paper. The base paper is coated on both sides.

By the inclusion of an anionic polyacrylamide and a cationic starch in the base paper according to this invention, there is obtained a photographic paper support which, as compared with a conventional polyolefin coated paper support, is protected to a far higher degree against the penetration of developers through the edges and, hence, against the edge stain occurring later on a photographic paper which has been treated in an automatic processor or the like.

The present polyolefin-coated support for photographic paper is used in color print papers, monochrome (black and white) print papers, photocomposing print papers and photocopying print papers.

The invention is illustrated below in detail with reference to Examples, but the invention is not limited thereto. In Examples, all parts and percents are by weight.

EXAMPLE 1

A paper sheet, 150 g/m$^2$ in basis weight, comprising the following amounts of ingredients was hand made and dried over a cylindrical dryer at 105° C.

| | Parts |
|---|---|
| A mixture (1:1) of bleached kraft hardwood pulp and bleached sulfite softwood pulp, which had been beaten to a Canadian standard freeness of 350 ml | 100 |
| An anionic polyacrylamide ("Star Gum A-15" of Seiko Kagaku) | 0.3 |
| A cationic starch ("Cato-2" of Oji National) | 2.5 |
| An epoxidized higher fatty acid amide ("NS-715" of Kindai Kagaku) | 0.3 |
| An alkylketene dimer ("Hercon 40" of DIC-Hercules) | 0.5 |

The hand-made paper sheet was incorporated with 1.5 g/m$^2$ of polyvinyl alcohol by tub sizing, passed through a super calender at a pressure of 90 kg per lineal cm, treated with corona discharge, and extrusion-coated, at a resin temperature of 330° C., on one side with low-density polyethylene containing 10% of titanium oxide, 30$\mu$ in thickness, and on the reverse side with low-density polyethylene, 30$\mu$ in thickness, to obtain a photographic paper support (Sample No. 1-1).

COMPARATIVE EXAMPLE 1

Four kinds of photographic paper supports were prepared in the same manner as in Example 1, except that in each case 2.8 parts (the same as in Example 1) of one of the following 4 reinforcing agents (including mixtures) were added in place of the combination of an anionic polyacrylamide and a cationic starch (Sample No. 1-2, 1-3, 1-4 and 1-5).

Reinforcing agents:

(1) Anionic polyacrylamide ("Star Gum A-15" of Seiko Kagaku)
(2) Cationic starch ("Cato 2" of Oji National)
(3) Mixture of 0.3 part of carbonyl-modified polyvinyl alcohol ("Gosenal T-330H" of Nippon Synthetic Chemical) and 2.5 parts of cationic starch ("Cato 2" of Oji National).
(4) Mixture of 1.0 part of cornstarch (Nichiden Kagaku) and 1.8 parts of cationic polyacrylamide ("Star Gum K-15" of Seiko Kagaku).

The results obtained in Example 1 and Comparative Example 1 were as summarized in Table 1.

TABLE 1

| | Sample No. | Strength agent | Peeling resistance (g/1.5 cm) | Distance of penetration (mm/100) | Edge stain (density index) |
|---|---|---|---|---|---|
| Example 1 | 1-1 | Anionic polyacrylamide + cationic starch | 100 | 35 | 0.5 |
| Comparative Example 1 | 1-2 | Anionic polyacrylamide | 130 | 70 | 1.8 |
| | 1-3 | Cationic Starch | 60 | 45 | 1.8 |
| | 1-4 | Carboxyl-modified polyvinyl alcohol + cationic starch | 120 | 35 | 1.2 |
| | 1-5 | Cornstarch + cationic polyacrylamide | 140 | 35 | 1.0 |

From the results shown in Table 1, it is apparent that no satisfactory edge stain inhibitive effect was exhibited by an anionic or cationic strength agent alone or by combinations of anionic and cationic strength agents except for a combination of an anionic polyacrylamide and a cationic starch, whereas a combination of an anionic polyacrylamide and a cationic starch exhibited a satisfactory edge stain inhibitive effect.

EXAMPLE 2

Five kinds of photographic paper supports were prepared in the same manner as in Example 1, except that the following amounts of ingredients were used (Sample Nos. 2-1, 2-2, 2-3, 2-4 and 2-5 in which mixtures of an anionic polyacrylamide and a cationic starch in various weight ratios were used).

| | Parts |
|---|---|
| The same pulp as used in Example 1 | 100 |
| A mixture of an anionic polyacrylamide ("Star Gum A-15" of Seiko Kagaku) and a cationic starch ("Cato 2" of Oji National) in varied weight ratios: 1/40, 1/30, 1/7, 1/3 and 1/2. | 3.0 |
| An alkylketene dimer ("Aquapel" of DIC Hercules) | 0.5 |
| Polyaminopolyamide-epichlorohydrin ("Epi-Nox of DIC Hercules) | 0.5 |

The results obtained were as summarized in Table 2.

TABLE 2

| | Sample No. | Weight ratio of anionic polyacrylamide to cationic starch | Peeling resistance (g/1.5 cm) | Distance of penetration (mm/100) | Edge stain (density index) |
|---|---|---|---|---|---|
| Example 2 | 2-1 | 1/40 | 70 | 45 | 1.5 |
| | 2-2 | 1/30 | 90 | 40 | 0.6 |
| | 2-3 | 1/7 | 110 | 40 | 0.5 |
| | 2-4 | 1/3 | 120 | 45 | 0.7 |

TABLE 2-continued

| Sample No. | Weight ratio of anionic polyacrylamide to cationic starch | Peeling resistance (g/1.5 cm) | Distance of penetration (mm/100) | Edge stain (density index) |
|---|---|---|---|---|
| 2-5 | 1/2 | 130 | 65 | 1.4 |

From the results shown in Table 2, it is seen that when the weight ratio of an anionic polyacrylamide to a cationic starch is in the range of 1/30 to ⅓, the edge stain inhibitive effect is sufficient, while when said ratio is below 1/30, the effect becomes insufficient, and that when the ratio exceeds ⅓, the distance of penetration of a developer becomes larger because of a decrease in the size effect and the edge stain becomes also higher.

EXAMPLE 3

Photographic paper supports were prepared in the same manner as in Example 1, except that an alkylketene dimer "Aquapel 360XC" made by DIC Hercules was used and the weight ratio of Aquapel 360XC to an epoxidized higher fatty acid amide ("NS-715") was varied in 5 steps as shown below.

| | Sample No. | Aquapel 360XC | NS 715 |
|---|---|---|---|
| Example 3 | 3-1 | 0.15 | 0.45 |
| | 3-2 | 0.23 | 0.37 |
| | 3-3 | 0.3 | 0.3 |
| | 3-4 | 0.52 | 0.08 |
| | 3-5 | 0.56 | 0.04 |

The results obtained were as shown in Table 3.

TABLE 3

| | Sample No. | Peeling resistance (g/1.5 cm) | Distance of penetration (mm/100) | Edge stain (density index) |
|---|---|---|---|---|
| Example 3 | 3-1 | 70 | 45 | 0.8 |
| | 3-2 | 80 | 40 | 0.6 |
| | 3-3 | 100 | 35 | 0.5 |
| | 3-4 | 90 | 40 | 0.6 |
| | 3-5 | 60 | 50 | 0.8 |

The photographic paper supports obtained above showed none of the adverse effects, such as fogging, which are injurious to the photographic properties of the photographic paper.

Note 1: The peeling resistance was tested on a test specimen, 1.5×10 cm, of polyethylene-coated photographic paper support at a separation angle of 90° and a separation speed of 200 mm/minute. The peeling resistance, which indicates the strength of base paper, is required to be at least 80 g for a photographic paper support.

Note 2: The distance of penetration was tested in the following manner: A photographic paper support comprising a base paper sheet coated on both sides with a polyethylene resin was coated with emulsions for the color print. The resulting color print paper was processed in an automatic continuous developing machine (Color Roll Processor made by FC Seisakusho Co.). After completion of the processing, the distance of penetration of the developer from the edge of the photographic paper was measured under a magnifying glass. Note 3: The edge stain was tested on a photographic paper sheet which was processed in the same manner as in Note 2 and aged for 5 days at 50° C. and 65% RH. The density of discoloration of the part of paper near the edge (edge stain) was measured by means of a microdensitometer (Microphotometer made by Union Kagaku Co.).

The edge stain should be 0.8 or less in terms of density index in order not to spoil the photographic value of the print.

What is claimed is:

1. A paper support for use in a photographic element comprising a base paper coated on both sides with a polyolefin resin, the base paper including an anionic polyacrylamide, cationic starch, an organic ketene dimer and an epoxidized higher fatty acids amide; the weight ratio of the anionic polyacrylamide to the cationic starch being 1/30 to ⅓; the weight ratio of the organic ketene dimer to the epoxidized higher fatty acid amide being from 3/5 to 7/1; and the weight ratio of the anionic polyacrylamide plus the cationic starch to the organic ketene dimer being 4.06 to 9.13, the cationic starch being 2.25 to 2.9% by weight based on the weight of the pulp.

2. A paper support according to claim 1 wherein the polyolefin resin is polyethylene or polypropylene.

3. A paper support according to claim 2 wherein the polyolefin resin is polyethylene.

* * * * *